United States Patent [19]

Troth

[11] 4,116,134

[45] Sep. 26, 1978

[54] HANGERS FOR OVERHEAD SUSPENDED TRACK

[75] Inventor: Paul H. Troth, Euclid, Ohio

[73] Assignee: McNeil Corporation, Akron, Ohio

[21] Appl. No.: 773,830

[22] Filed: Mar. 3, 1977

[51] Int. Cl.[2] ..... E01B 25/24

[52] U.S. Cl. ..... 104/111; 104/93; 105/150

[58] Field of Search ..... 104/89, 91, 93–95, 104/106, 107, 109–111; 105/150, 155

[56] References Cited

U.S. PATENT DOCUMENTS

| | | | |
|---|---|---|---|
| 493,216 | 3/1893 | Louden | 104/109 |
| 2,076,106 | 4/1937 | Wehr | 104/111 |
| 2,156,827 | 5/1939 | Wehr | 104/111 |
| 3,095,174 | 6/1963 | Dehn et al. | 104/111 |
| 3,219,199 | 11/1965 | Lagerstrom | 104/93 |

FOREIGN PATENT DOCUMENTS

| | | | |
|---|---|---|---|
| 2,456,304 | 10/1976 | Fed. Rep. of Germany | 104/106 |
| 1,057,554 | 2/1967 | United Kingdom | 104/109 |

*Primary Examiner*—Drayton E. Hoffman
*Assistant Examiner*—Carl Rowold
*Attorney, Agent, or Firm*—Watts, Hoffmann, Fisher & Heinke, Co.

[57] ABSTRACT

An overhead suspended monorail type material handling system or apparatus comprising a rail having a web and a transversely extending flange on each side along its upper edge and a wider flange on each side along its lower edge, a plate-like member or cleat for attachment to an overhead structure and provided wth a through aperture enlarged at one end, a bolt-like load supporting stud shaft or hanger member having a head at one end and a nut at the other end with the nut located in the enlarged part of the aperture through the cleat and the shank of the bolt-like hanger member extending to the other side of the cleat member, and a pair of clamp plates bolted together, the clamp plates providing an inverted T-like aperture therebetween enclosing the head of the bolt-like hanger member and the narrower flanges on a part of the rail. As an alternative construction the headed stud or hanger member may be incorporated into the cleat.

1 Claim, 9 Drawing Figures

HANGERS FOR OVERHEAD SUSPENDED TRACK

BACKGROUND OF THE INVENTION

1. Field of Invention

The invention relates to overhead rail-type material handling systems or apparatuses and more particularly to a suspension support for the rail of such apparatus.

2. Description of the Prior Art

Overhead rail-type material handling apparatuses having the rail part thereof supported by ball and socket suspension devices, and the like, are known but such systems are typically not suitable for use in applications where overhead is extremely limited, for example, in a mine. Typical prior art overhead, rail-type material handling apparatus are shown in United States patents to William G. Wehr U.S. Pat. No. 2,156,827 and Karl A. Pamer U.S. Pat. No. 3,827,366.

SUMMARY OF THE INVENTION

The invention provides a novel and improved overhead suspended rail-type material handling apparatus, especially of the permanent installation type, for installation where overhead clearance is extremely limited and in which the rail is supported very close to the overhead supporting structure.

The invention further provides a novel and improved suspension device having pivoted parts, for an inverted T-shaped rail having top flanges, of an overhead suspended rail-type material handling apparatus which permits a degree of misalignment and is otherwise easy to install, is reliable in operaiton, and supports the rail with limited flexability close to the ceiling or other overhead structure underneath which the apparatus is installed.

More specifically the invention provides a novel and improved suspension device of the character referred to comprising a cleat for attachment to overhead structure and having a depending load supporting stud or hanger member with an enlarged end underneath the cleat proper, incorporated in or attached to the cleat, and a pair of clamp plates detachably connected together and providing an inverted T-shaped slot therebetween enclosing the enlarged end of the load supporting stud or hanger member and the top flanges on a part of the rail.

DESCRIPTION OF A PREFERRED EMBODIMENT

Figure 1:
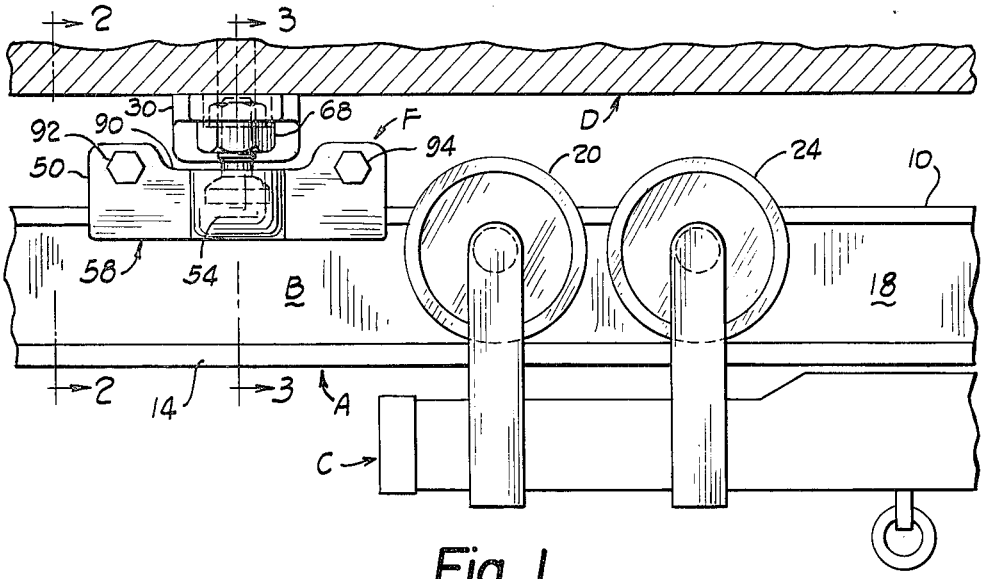
FIG. 1 is a fragmentary view approximately on the line 1—1 of FIG. 3 of an overhead suspended monorail type material handling system embodying the present invention.

The invention is designed for and has special utility in overhead rail-type material handling systems installed in locations having very limited overhead clearance and is herein shown as embodied in such apparatus.

Referring to the drawings, the reference character A designates generally an overhead, monorail, material handling apparatus comprising an overhead rail B of inverted T-shape along which a trolley C is movable. The trolley C, illustrated, is of the hand-propelled, material carrier type. The term "trolley" as herein employed refers to any equipment supported by and movable along the rail B such as hand and/or power-propelled carriers, tractors, crane trucks, etc. The rail B is suspended from an overhead structure, such as, an I-beam girder D of a building or the roof E of a mine closely adjacent to the underside of the overhead structure by suspension supports suitably located along the rail B.

The suspension supports each includes a plate-like member or cleat for attachment to an overhead structure and having a hanger member with an enlarged ball-like head at its lower end attached to or incorporated in the cleat member and pair of plate-like members parts of which are formed to clamp about the head of the hanger member and lower parts of which are adapted to clamp about the top narrow flanges of the rail. The rails shown in the various depicted embodiments of the invention are duplicated and designated by a reference character B. The top narrow flanges of the rail B are designated 10,12, the wider lower flanges 14,16 and the web 18. The wheels 20 of the carrier C travel along the wider lower flanges 14–16 of the rail.

Figure 2:
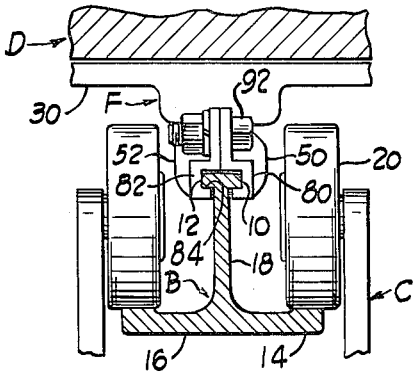
FIG. 2 is a fragmentary sectional view approximately on the line 2—2 of FIG. 1.
Figure 3:
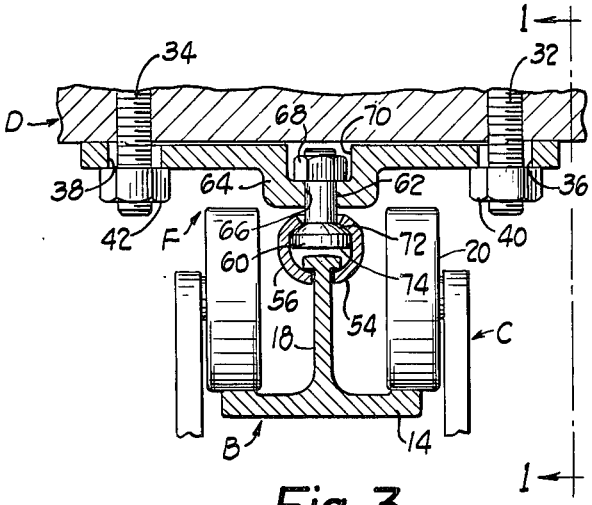
FIG. 3 is a fragmentary sectional view, with parts in elevation, approximately on the line 3—3 of FIG. 1.

The cleat member 30 of the suspension F shown in FIGS. 1–3 is detachably connected to the overhead structure which is the I-beam D by bolts or studs 32,34 threaded shanks of which extend downwardly from the overhead structure through slots 36,38 in the cleat member and nuts 40,42 threaded onto the extending ends of the bolts or studs 32,34. The slots 36,38 are elongated preferably in the direction transversely of the length of the rail to take care of slight misalignment of the cleat member and rail and thus facilitate installation, etc. of the apparatus.

The clamp plates 50,52 have hollow semi-spherically shaped center parts 54,56 which when the clamp plates are connected together to form a clamp assembly, designated generally by the reference character 58, provide a hollow bulb-shape structure which surrounds and encloses the enlarged head of the hanger member or part of the cleat which in this instance is the head 60 of the bolt 62. The central part of the cleat plate 30 is depressed to form a downwardly projecting cylindrical boss 64 having a central aperture 66 through which the shank of the bolt 62 extends. A nut 68 threaded onto the upper end of the bolt 62 and located in a recess 70 in the upper side of the cleat connects the hanger member or bolt to the cleat. The bearing face 72 of the head 60 is "round", that is, semi-spherical. The opposite or lower face 74 of the bolt head 60 is flat. The round opening in the hollow bulb-shaped part of the clamp assembly through which the shank of the bolt 62 extends is slightly larger than the shank of the bolt to allow the clamp assembly 58 and in turn the rail connected thereto to pivot slightly on the head of the bolt 62.

The lower parts of the clamp plates 50,52 at opposite sides of the semi-spherical center parts 54,56 are formed with reverse bends 80,82 to provide T-slots 84 at opposite sides of the parts 54,56, which slots open into the lower side of the clamp assembly 58 and within which parts of the top of the rail B and more particularly the upper narrow flanges 10,12 of the rail are received and clamped. The construction is such as to provide a clamp assembly 58 with an inverted T-slot having a through aperture intermediate the ends of the slot a part of which is spherical-shaped. The shank of the bolt 62 is as short as possible providing only sufficient clearance between the cleat 30 and the clamp assembly 58 to allow the clamp assembly and the rail connected thereto to pivot slightly about the head 60 of the bolt 62. The fact that the lower face 74 of the head 60 of the bolt 62 facing the rail B is flat provides clearance for that part of the rail extending through the bulbar part of the clamp assembly without appreciably increasing the distance between the rail B and the overhead structure D.

The upper sides of the clamp plates 50,52 are recessed as indicated by the reference characters 90 and are located closely adjacent to the underside of the cleat member 30 with the ends of the clamp members extending upwardly around the center downwardly projecting part 64 of the cleat member thus reducing the overall height of the suspension F. The clamp members 50,52 are detachably connected together to form the clamp assembly 58 as by bolts 92,94 or other suitable means such as the U-shaped members 96,98 shown in the suspension G depicted in FIGS. 4 to 6. The ends of the clamp members 50,52 shown in FIGS. 4 to 6 extend into the channels of the members 96,98 and the parts are held in assembled relation by cotter pins 100,102, or the like, extending through aligned apertures in the members 96,98 and the ends of the clamp members 50,52.

The cleat member 110 of suspension G is similar to the cleat member 30 of FIGS. 1 to 3. The shank of the hanger member 112 which member is similar to the member 60 of suspension F is unthreaded and extends merely to the upper side of the cleat member where it is fixed to the cleat member by a weld 114. Since the nut 68 employed in suspension F is omitted and the shank of the hanger member 112 is shorter than that of the hanger member 62 the depression in the center of the cleat may be made shallower or omitted as desired. If the cleat member was a cast or forged article the hanger member could be formed integral with it.

Figure 4:
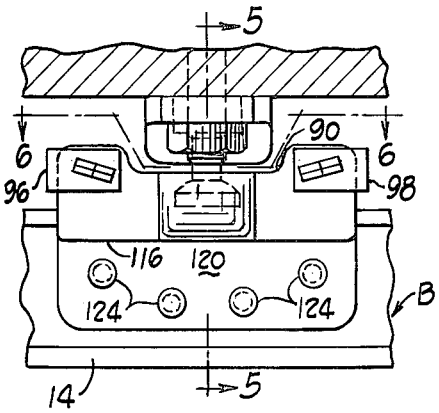
FIG. 4 is a fragmentary view of an overhead suspended material handling system similar to that depicted in FIG. 1 but showing modified constructions.
Figure 5:
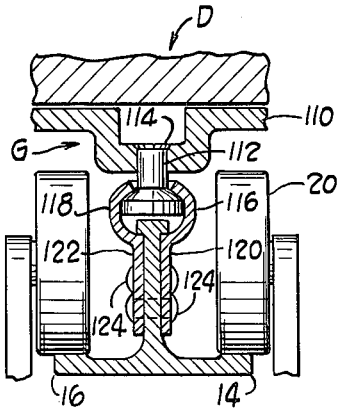
FIG. 5 is a fragmentary sectional view, with parts in elevation, approximately on the line 5—5 of FIG. 4.
Figure 6:
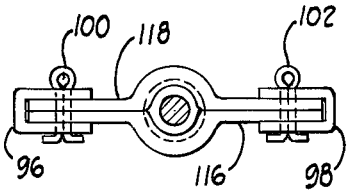
FIG. 6 is a fragmentary sectional view approximately on the line 6—6 of FIG. 4.
Figure 7:
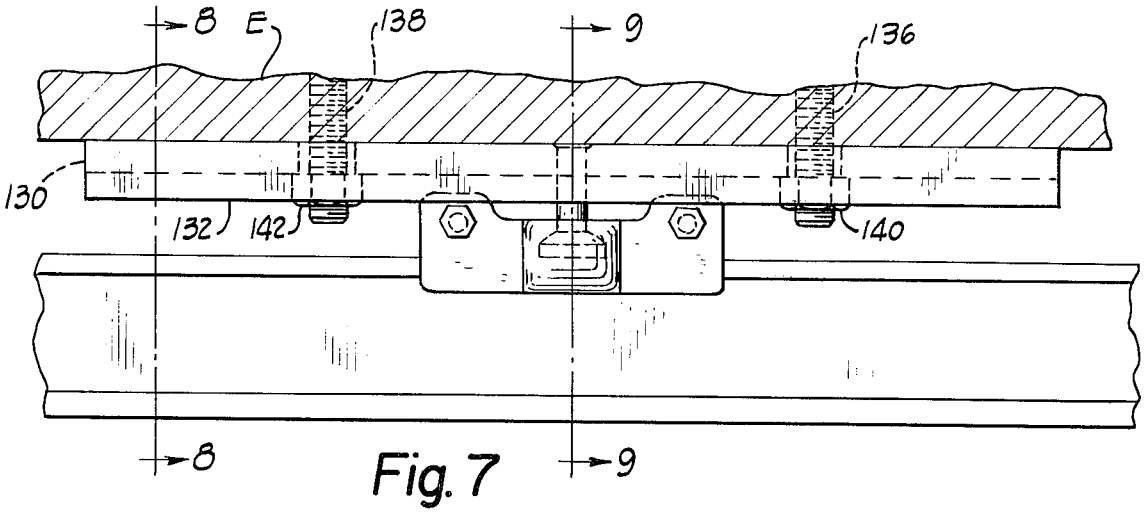
FIG. 7 is a fragmentary view approximately on the line 7—7 of FIG. 8 of an overhead suspended material handling system similar to that shown in FIG. 1 but showing further modified constructions.
Figure 8:
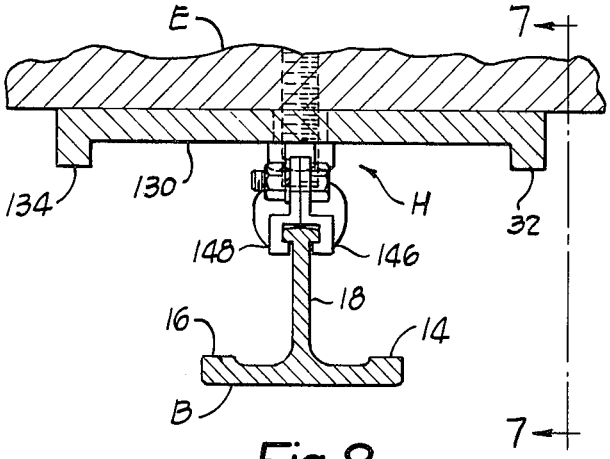
FIG. 8 is a fragmentary sectional view approximately on the line 8—8 of FIG. 7.
Figure 9:
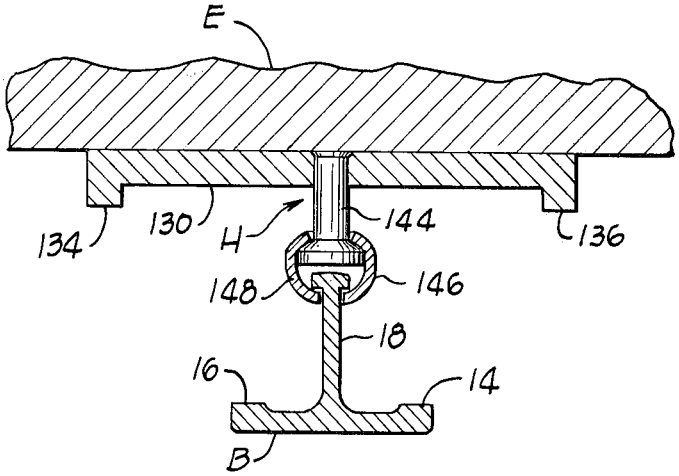
FIG. 9 is a fragmentary sectional view with parts in elevation approximately on the line 9—9 of FIG. 7.

In some applications it may be desirable to extend the plate-like clamp members downwardly along the opposite sides of the web of the rail B as depicted in FIGS. 4 to 6. The plate-like clamp members 116,118 shown in FIGS. 4 to 6 are similar to the clamp members 50,52 supplemented by parts 120,122 extending downwardly along opposite sides of the web 18 of the rail. The parts 120,122 of the clamp members 116,118 are fixed to the web of the rail B by rivets 124, or nuts and bolts, as desired.

Where the invention is to be used in a mine the cleat member of the suspension is preferably enlarged to assist in supporting the roof as is the cleat member 130 of the suspension H shown in FIGS. 7–9. The cleat member 130 is a flat metal plate with downwardly extending flanges 132,134 along opposite sides for added strength and is connected to the roof E by screws or anchor fasteners 136,138 having nuts 140,142 threaded onto their lower end which extend downwardly through suitable apertures in the cleat members 130. The hanger member 144 is similar to the hanger member 112 of FIGS. 4 to 6 and the clamp plates 146,148 are like the clamp plates 50,52 of FIGS. 1 to 3.

From the foregoing description of preferred embodiments of the invention it will be apparent that the objects heretofore mentioned and others having been accomplished and that there has been provided a novel and improved overhead rail-type material handling system or apparatus and more particularly an overhead rail suspension support designed especially for applications where overhead clearance is extremely limited. The apparatus provides limited pivoted movement of the rail, and is readily installed as the design is simple and allows for some misalignment of parts during installation.

Preferred embodiments of the invention have been described in considerable detail but it is to be understood that the invention is not limited to the constructions shown and described and it is the intention to hereby cover all adaptations, modifications and uses thereof which come within the practice of those skilled in the art to which the invention pertains and the scope of the appended claims.

What is claimed is:

1. In an overhead suspended rail-type material handling apparatus, a rail comprising a web and transversely extending flanges on both sides of said web adjacent to the opposite edge thereof, a cleat member including a plate-like part for attachment to an overhead structure and a hanger part projecting from the plate-like part provided with an enlargement adjacent to one of its free ends having a semi-spherical bearing surface facing the plate-like part, a pair of clamp plates of similar shape orientated lengthwise of said rail and having recesses facing one another providing a spherical-like aperture therebetween the walls of which enclose said enlargement at the projecting end of said hanger part and a T-slot at each opposite side of said plates that intersect the spherical-like aperture the walls of which T-slots engage about the narrower flanges on a part of said rail, and means securing said clamp plates together.

* * * * *